United States Patent [19]

Negro

[11] 4,267,865

[45] May 19, 1981

[54] APPARATUS FOR PRODUCING COILS

[75] Inventor: Guido Negro, Neuffen, Fed. Rep. of Germany

[73] Assignee: Bielomatik Leuze GmbH & Co., Fed. Rep. of Germany

[21] Appl. No.: 69,456

[22] Filed: Aug. 24, 1979

[30] Foreign Application Priority Data

Aug. 31, 1978 [DE] Fed. Rep. of Germany ..... 2837946

[51] Int. Cl.[3] ..... B21F 3/04; B21F 45/00

[52] U.S. Cl. ..... 140/92.94; 140/92.93

[58] Field of Search ..... 140/71 C, 92.3, 92.93, 140/92.94; 11/1 R, 1 AC

[56] References Cited

U.S. PATENT DOCUMENTS 2,182,844 12/1939 Grumbacher ..... 140/92.94
2,808,079 10/1957 Tauber ..... 140/92.3
3,407,851 10/1968 Ostermeier ..... 140/92.93
3,826,290 7/1974 Pfaffle ..... 140/92.3 X

*Primary Examiner*—Richard B. Lazarus
*Attorney, Agent, or Firm*—Steele, Gould & Fried

[57] ABSTRACT

An apparatus is provided for producing coils in the course of a process for the production of binding coils which are to be introduced directly into a row of holes in a pack of sheets. The apparatus has a winding spindle which is surrounded by the coil produced, from which the coil lifts when the front end of the coil is stopped, the winding spindle being driven continuously. A cutting device, for example in the form of scissors is provided for cutting the coil. A device for stopping the front end of the coil periodically is provided between the winding spindle and the cutting device, the stopping device being arranged to operate with a timing correlated with the operation of the cutting device.

13 Claims, 3 Drawing Figures

APPARATUS FOR PRODUCING COILS

FIELD OF THE INVENTION

The invention relates to an apparatus for producing coils in the course of a process for the production of binding coils which are to be introduced directly into a row of holes in a pack of sheets, the apparatus comprising a winding spindle which is surrounded by the coil produced, from which the coil lifts when the front end of the coil stops, and a cutting device for the coil.

BACKGROUND OF THE INVENTION

An apparatus of this type has been disclosed in German Pat. No. 11 89 513, in which the winding spindle is driven by an intermittent drive means, for example a braking motor (see also German Pat. No. 19 44 223), when a spiral of binding coils is rotated to introduce it into the above mentioned row of holes. The braking motor was stopped again at the end of the spiralling operation, the coil cut to length and the winding spindle started up again once a new pack of sheets had been inserted in to the spiralling unit. According to German Pat. No. 11 89 513, the winding spindle is designed in such a way that if the coil is wound in defectively, for example owing to a blocked hole in the row of holes, the coil is stopped automatically as the wire can rise from the winding spindle.

The known apparatus suffered from the problem that driving the winding spindle by means of a braking motor, i.e. a motor which could be switched on and off with high frequency, meant that the motor had to be accelerated from standstill to its nominal speed during each winding process and then braked to a standstill again. The spiral was then cut to length.

The performance i.e. the number of operations per unit time (the number of spirals introduced per unit time), of the known apparatuses cannot be varied at will. As the winding tool can only operate while the pack of sheets is ready for winding in the spiralling unit and, moreover, time has to be allowed for cutting the ends of the spiral, it is necessary to carry out the actual spiralling operation in a very short time. A little more than a second remains for the spiralling operation if the apparatus carries out 30 operations per minute. Attempts have been made to operate with braking motors having higher performances, but they did not lead to any improvement in the rate of operation. Attempts have also been made to operate with a continuous drive and to switch on the winding spindle by means of mechanical or electromechanical couplings. These attempts did not produce a practically serviceable apparatus with a higher performance either.

German Pat. No. 19 44 223 describes an apparatus designed to have a higher performance, in which the spirals are continuously produced and cut to length, but not rotated directly into a pack of sheets. Instead the spirals are stored for an intermediate period and then rotated into the pack using a special winding device. Although the performance could be increased using this apparatus, it was very complicated and expensive to produce.

BRIEF SUMMARY OF THE INVENTION

The object of the invention is to provide an apparatus which is simple, provides direct introduction of the coils into the spiralling unit, and allows high operating speeds.

According to the invention there is provided an apparatus for producing coils in the course of a process for the production of binding coils which are to be introduced directly into a row of holes in a pack of sheets, the apparatus comprising a continuously driven winding spindle which is surrounded by the coil produced, from which the coil lifts when the front or cut end of the coil is stopped, means for cutting device for the coil, and means for stopping the front or cut end of the coil periodically, the stopping means being located between the winding spindle and the cutting device and being arranged to operate with a timing correlated with the operation of the cutting means.

The invention makes use of the basic principle known from German Pat. No. 11 89 513 which allows operation with a winding spindle which is driven continuously by a simple continuously running motor or preferably by an overall drive by the production machine. In an embodiment of the invention the stopping means is a stop on which the coil rests after the cutting operation so that the coil rises from the winding spindle which runs continuously. The pack into which a spiral has been inserted can be removed from the spiralling unit during this period and a new pack into which a spiral has not yet been inserted can be introduced. The stop is subsequently removed from the path of the front or cut end of the coil, the coil which is sprung somewhat by the stopping of the front end springs forward, is grasped by the winding spindle and twisted into the new pack of sheets. As this apparatus operates almost without inertia, it is possible to achieve extremely short start up times for the coil so that the performance of the apparatus can be increased. An expensive braking motor which consumes a lot of energy is therefore not needed.

According to a particularly advantageous embodiment of the invention, the stop can be arranged immediately adjacent to the cutting plane. The braking which already occurs during cutting is thus utilized with the total stoppage of the coil.

In a particularly simple embodiment the stop is formed by the moving blade of the cutting device. This embodiment not only avoids the need for an expensive braking motor but also needs no more components than known apparatus.

It is also preferable for the cutting device to operate in the manner of scissors or tongs having a moving blade and a fixed blade the moving blade lying in the direction of rotation of the coil downstream of the fixed blade. The rear blade of the scissors or tongs thus holds the front end of the coil and forms the stop. The stop can also be a clamping device which can be formed, for example by the blades which are moved together in the manner of scissors or jaws. The tendency for the front end to break out under certain circumstances can thereby be eliminated, for example in the case of particularly large and thin coils.

DESCRIPTION OF ILLUSTRATED EMBODIMENTS

Figure 1:
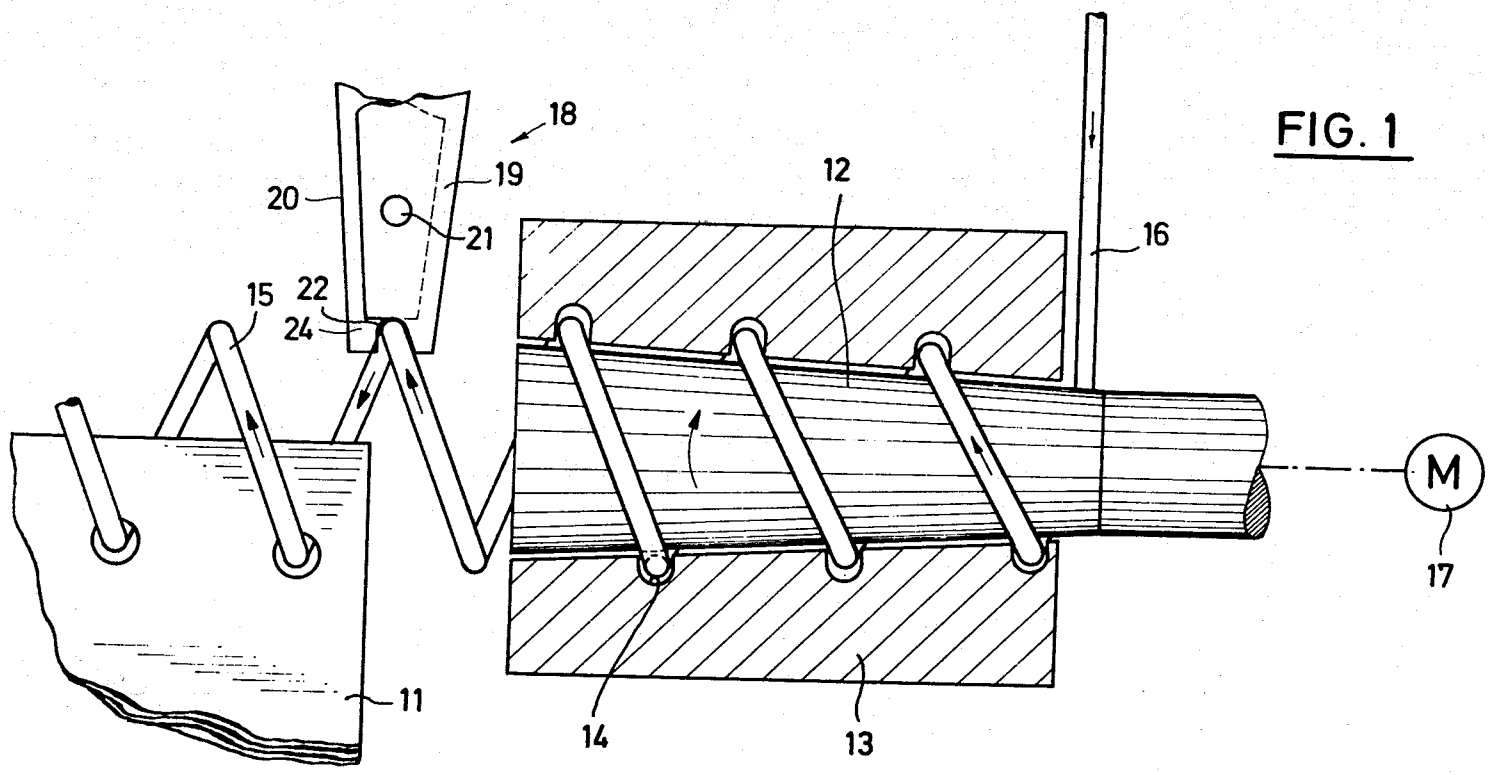
FIG. 1 shows a schematic side view of a portion of a spiralling unit in a first operating position during the winding in of the coil.

The drawings show a portion of a spiralling unit which, in turn, is normally a portion of an entire machine for the production of so-called spiral-bound products such as, for example, shorthand pads. Packs of sheets 11 which have a row of holes along their back edge are introduced into the apparatus by a conveyor (not shown) and positioned adjacent the front end of a winding spindle 12 with their rows of holes directed toward it. The winding spindle has the shape of an elongate, cantilevered shaft which widens slightly in frusto-conical fashion towards its free end. The shaft is surrounded by a sleeve 13 which has a spiral groove 14 in its region adjacent to the winding spindle, the depth of the groove being greater than the thickness of the wire 16 forming the coil 15, which can be a metal, plastic or plastic-coated metal wire. For the sake of simplicity, the winding spindle has been shortened in FIG. 1, and shown with only a few windings, and the conicity has been greatly exaggerated. A larger number of windings will usually lie on the winding spindle.

It should be noted here that the illustrated apparatus with a fursto-conical spindle and a spiral groove provided in a tube is a particularly preferred method, but not the only method of producing a winding spindle which automatically grasps the wire and releases the front end. The winding spindle can also be cylindrical and stepped, in which case transition members can be provided if necessary. The groove can be replaced by suitably arranged pins or rollers.

The winding spindle 12 is driven by a motor 17, which is only illustrated diagrammatically, or, and this is particularly preferable, by the drive means (synchronizing shaft) of the entire machine.

A cutting means 18 is provided at the end of the winding spindle and upstream of the pack of sheets and, in the example illustrated, consists of a fixed blade 19 and a moving blade 20 which are joined together by means of a shaft 21 and are pivotal relative to each other. The blades have cutting edges 22 which are shaped in such a way that they define a U-shaped recess between them in the opened state, (FIG. 1), through which the coil 15 can pass freely. The fixed blade 19 lies at the front of FIG. 1, the coil running from the front to the back through the plane of the drawing in this region.

FIG. 1 shows the normal operating conditions in which the winding tool produces the coil 15 from the wire 16 and twists it into the row of holes in the pack of sheets 11. Owing to the frusto-conical shape of the winding spindle, the coil produced lies firmly round it, and, under certain circumstances, draws the wire 16 against a considerable resistance, overcoming the bending-shaping operation. The coil runs between the cutting edges of the cutting device and is rotated into the pack of sheets.

Once the coil has been wound completely into the pack of sheets, the cutting device 18 is actuated. In this process, the fixed blade 19 remains stationary and the moving blade 20 pivots in an anticlockwise direction in the drawing so that the cutting gap closes and the cutting edges 22 severe the coil. In this position, the surface of the moving blade 20 which is adjacent to the cutting edge and forms a stop 24 blocks the path of the front or cut end 25 of the coil so that the front end of the spiral is stopped. As the coil is entrained by the winding spindle, the diameter of the spiral widens, assisted by the resilience of the wire which is usually sprung and the windings lying round the winding spindle rise from the winding spindle in the groove 14. Slight friction at some points between the winding spindle and the wire is sufficient to maintain this condition. The blade 20 thus remains in the position illustrated in FIG. 2, while the finished block is carried off preferably after a deflection of the front and rear end of the coil performed by an apparatus which is not shown, and a new pack of sheets is presented. The blade 20 is then pivoted back into the position in FIG. 1 and the front or cut end 25 is thus released so that the coil springs forward and lies on the winding spindle again. The frusto-conical shape assists this action. The winding spindle which runs continuously in the intermediate period now grasps the coil immediately and begins to wind it into the pack of sheets.

With sensitive wires, for example plastic coated wires, the friction which remains between the wires and the winding spindle even when the coil is raised can heat the wire to an impermissible extent or can damage it over a prolonged period. It is therefore preferable to provide a device which switches off the motor 17 or releases the drive connection to the machine if one or several blocks is not present, which would lead to a pause in the production of the coil. This device can be controlled, for example, by a sensor which is in any case normally provided for the pack of sheets 11, or by a time switch. If a different type of cutting device is used, it is possible to provide a stop which is separate from it. It is also possible to connect the cutting device to a deflecting device for the rear end of the already wound coil.

Figure 2:
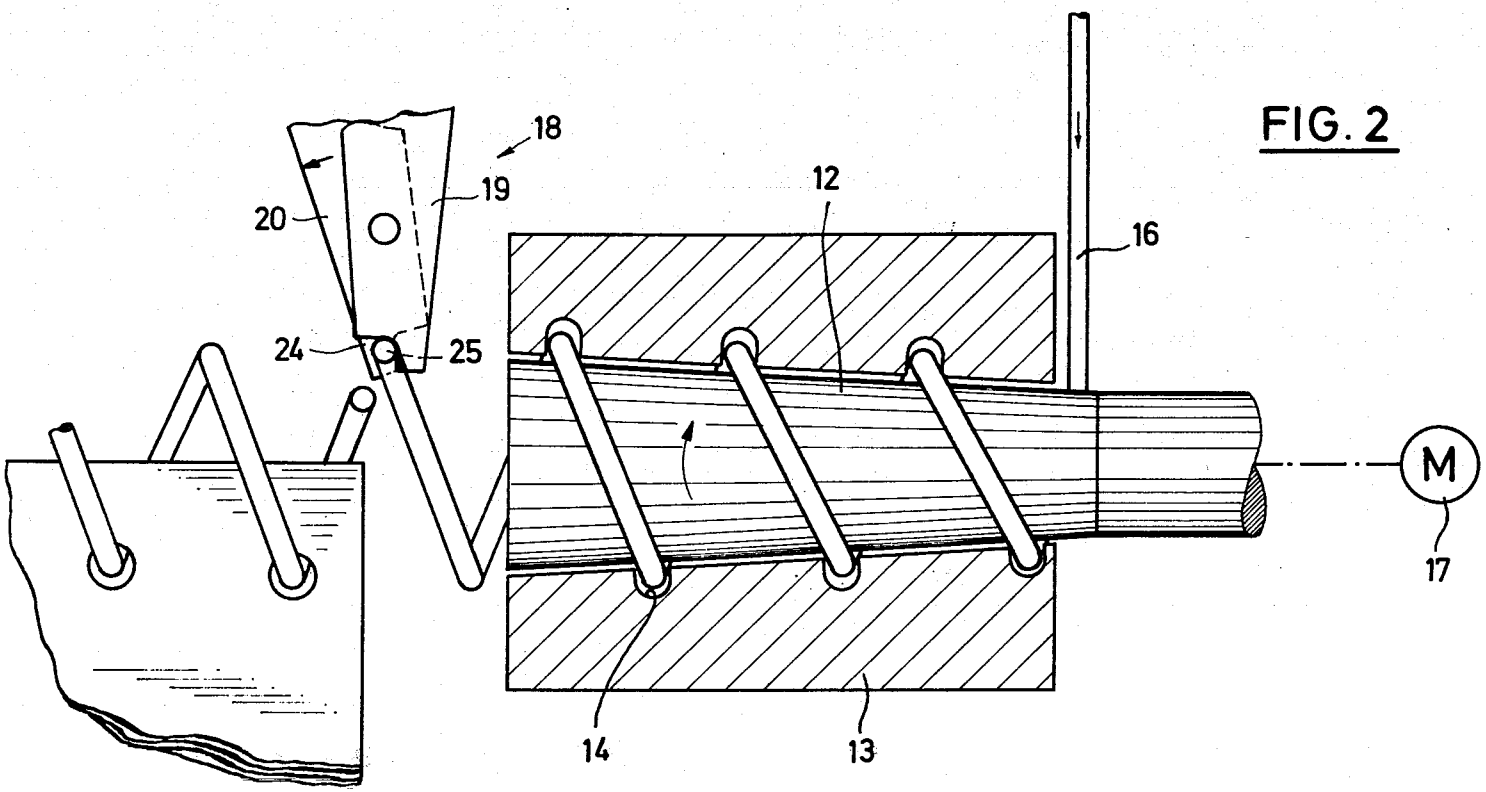
FIG. 2 shows the apparatus of FIG. 1 in a second operating position during the standstill of the coil.
Figure 3:
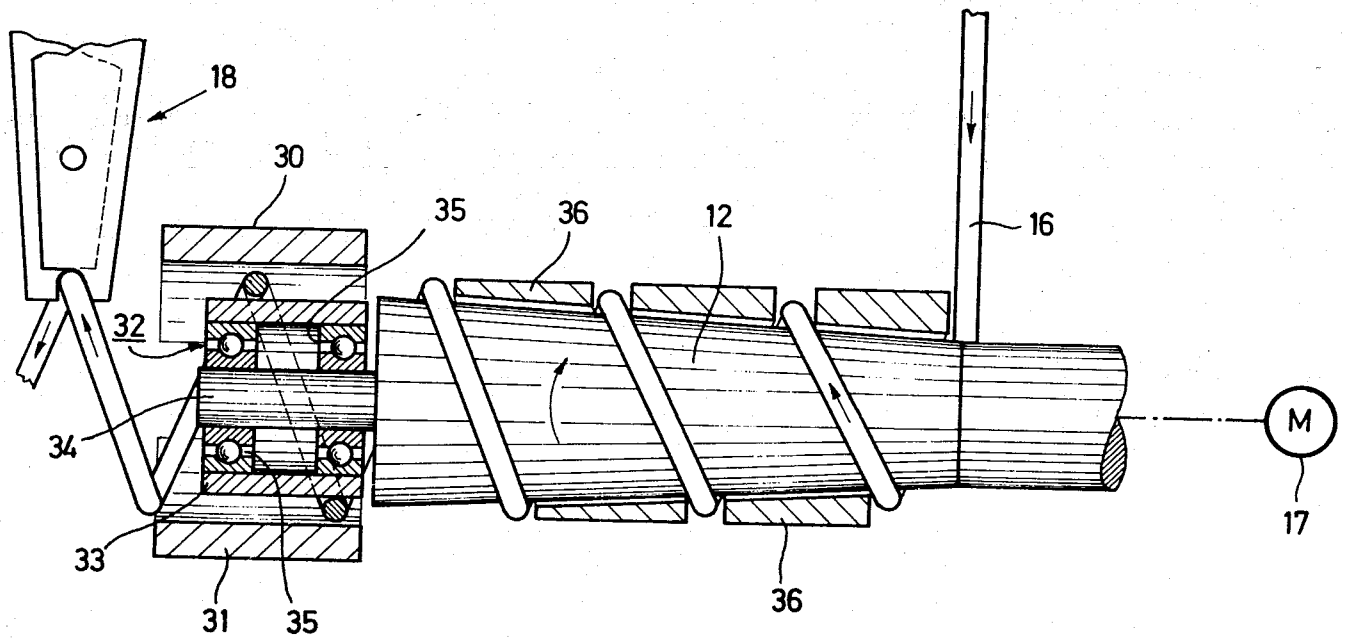
FIG. 3 shows a schematic partial view of another embodiment.

In the embodiment of the invention shown in FIG. 3, corresponding components are provided with the same reference numerals as in the embodiment in FIGS. 1 and 2. An additional clamping device for holding the portion of the coil which has already left the winding spindle is provided in the embodiment shown in FIG. 3 between the winding spindle 12 and the cutting means 18, which is designed the same as in the preceding embodiment. This clamping device has arcuate clamping jaws 30 and 31 which are arranged at a small distance from the coil on the outer circumference of the coil between the winding spindle 12 and the cutting means 18. A sleeve 33 is provided as a counter pressure member 32 for the clamping jaws 30 and 31, and is arranged inside the coil adjacent to the winding spindle 12. The sleeve 33 is mounted on a coaxial extension 34 of the winding pin 12 by means of two ballbearings 35 and is slightly smaller in diameter than the winding spindle at its end facing the cutting means 18. The diameter of the sleeve is thus substantially the same as the internal diameter of the released coil and allows the coil to slide away substantially without friction over the sleeve.

The clamping device is connected to a mechanically or hydraulically operating actuator (not shown in the drawing) which cooperates synchronously with the cutting means 18. When the wire 16 is cut, the wire is thus held not only by the cutting means 18 but at the same time by the clamping jaws 30 and 31 which press against the sleeve 33. This stabilizes the freshly produced coil and vibrations are avoided. When the clamping jaws 30 and 31 are open, the sleeve 33 normally runs at substantially the same speed as the winding spindle 12 so that the ballbearings 35 remain stationary. Once the clamping jaws 30 and 31 close, the sleeve is braked so that the extension 34 in the stationary sleeve 33 continues rotating. The sleeve 33 preferably has a small moving mass and advantageously consists of a hard aluminium alloy.

Instead of the sleeve 13 surrounding the winding spindle 12 as in the embodiment in FIGS. 1 and 2, a stationary, spirally extending guide rail 36 is provided in the embodiment in FIG. 3. The rail 36 has intermediate spaces corresponding to the grooves 14 for the wire 16. A guide rail 36 of this type allows the clamping jaws 30 and 31 to be extended in an axial direction over the winding spindle. In this case, the radial distance between the clamping jaws is such that they do not press the windings of wire located on the winding spindle against the winding spindle even in the braked condition, but rather contact and stabilize the wire whenever the coil on the winding spindle widens too much owing to the braking. It is also possible to provide the clamping device composed of the clamping jaws 30 and 31 in conjunction with the sleeve 33 as the only braking device so that the cutting device 18 serves only to cut and not to hold the free end of the wire of the coil.

I claim:

1. An apparatus for producing coils in the course of a process for the production of binding coils which are to be introduced directly into a row of holes in a pack of sheets, the apparatus comprising:

a continuously driven, coil-forming winding spindle which is surrounded by the coil produced thereon;

means for cutting the coil; and, means for periodically stopping the cut end of the forming coil, causing the coil to lift from the continuously driven spindle and interrupt the coil-forming process.

2. An apparatus according to claim 1, wherein the stopping means comprises a stop which is movable into the path of the cut end of the forming coil.

3. An apparatus according to claim 2, wherein the cutting means defines a cutting plane and the stop is arranged immediately adjacent the cutting plane.

4. An apparatus according to claim 2, wherein the cutting means comprises a moving blade the stop being an integral part thereof.

5. An apparatus according to claim 4, wherein the cutting means further comprises a fixed blade, the moving blade being downstream of the fixed blade in the direction of rotation of the coil.

6. A device according to claim 1, wherein the stopping means comprises clamping jaws.

7. An apparatus according to claim 6, wherein the clamping means engages at least on the exterior of of the coil.

8. An apparatus according to claim 7, wherein the clamping means engages both on the exterior and on the interior of the coil.

9. An apparatus according to claim 6, wherein the clamping means comprising arcuate clamping jaws, the internal curvature of which is substantially equal to the external curvature of a free binding coil.

10. An apparatus according to claim 6, wherein the axial length of the clamping jaws is equal to at least one pitch of the coil.

11. An apparatus according to claim 1, wherein the stopping means is disposed between the cutting means and the winding spindle.

12. An apparatus for producing coils in the course of a process for the production of binding coils which are to be introduced directly into a row of holes in a pack of sheets, the apparatus comprising:

a continuously driven winding spindle, which is surrounded by the coil produced, from which the coil lifts when the front end of the coil is stopped;

means for cutting the coil; and, means for stopping the front end of the coil, located between the winding spindle and the cutting device, comprising clamping jaws and a cylindrical counter pressure member for the clamping jaws arranged coaxially with the winding spindle, the external diameter of the counter pressure member being only slightly smaller than the internal diameter of the free binding coil.

13. An apparatus according to claim 12, wherein the counter pressure member is in the form of a sleeve which is rotatably mounted on an axial extension of the winding spindle.

* * * * *

UNITED STATES PATENT AND TRADEMARK OFFICE

CERTIFICATE OF CORRECTION

PATENT NO. : 4,267,865

DATED : May 19, 1981

INVENTOR(S) : Guido Negro

It is certified that error appears in the above-identified patent and that said Letters Patent are hereby corrected as shown below:

At column 2, line 10, delete "device for".

At column 3, line 25, delete "fursto" and insert --frusto--.

Signed and Sealed this

First Day of September 1981

[SEAL]

*Attest:*

GERALD J. MOSSINGHOFF

*Attesting Officer*

*Commissioner of Patents and Trademarks*